United States Patent [19]

Shiraha et al.

[11] Patent Number: 5,042,400

[45] Date of Patent: Aug. 27, 1991

[54] METHOD AND APPARATUS FOR PARTIAL COMBUSTION OF COAL

[75] Inventors: Michiro Shiraha, Kobe; Kenji Mori, Akashi; Shingo Suzuya, Ichikawa; Eiichi Harada, Akashi, all of Japan

[73] Assignee: Kawasaki Jukogyo Kabushiki Kaisha, Japan

[21] Appl. No.: 469,097

[22] Filed: Jan. 24, 1990

[51] Int. Cl.[5] ..... F23D 1/00

[52] U.S. Cl. ..... 110/244; 110/264; 110/347; 110/214

[58] Field of Search ..... 110/210, 211, 212, 213, 110/214, 264, 266

[56] References Cited

U.S. PATENT DOCUMENTS

| | | | |
|---|---|---|---|
| 3,124,086 | 3/1964 | Sage et al. | 110/347 |
| 4,800,825 | 1/1989 | Kuenzly | 110/264 |
| 4,850,288 | 7/1989 | Hoffert et al. | 110/264 |
| 4,873,930 | 10/1989 | Egense et al. | 110/264 |

*Primary Examiner*—Henry C. Yuen

[57] ABSTRACT

A first-stage furnace for partial combustion of solid fuel and oxidizer gas to generate inflammable exhaust gases which are passed to a secondary-stage furnace is shown. The first-stage furnace comprises a vertical pre-combustion chamber and a likewise cylindrical main combustion chamber mounted in horizontal position, connected downstream of the pre-combustion chamber through a tangential connecting passage. The air-fuel mixture introduced into the pre-combustion chamber is given swirling motion and burned at a temperature that converts the mixture to a mix of incompletely burned fuel particles, exhaust gases and non-combustible products in molten state. The mix stream into the tangential passage into the main combustion chamber develops into a high-velocity vortex, with the molten slag being centrifuged onto the inner wall of the main combustion chamber to form a film which is extracted out through a tapping port. Thus, the inflammable gases generated are free from non-combustible products such as ash, and conveyed to the secondary-stage furnace, through the gas transport duct.

7 Claims, 5 Drawing Sheets

METHOD AND APPARATUS FOR PARTIAL COMBUSTION OF COAL

BACKGROUND OF THE INVENTION

1) Field of the Invention

The present invention relates in general to an apparatus for partial combustion of fuel mixtures composed of pulverized bituminous or subbituminous coal and oxidizer gas at or above the ash fusion temperature to generate inflammable exhaust gases like as fuel for boilers. This invention is directed more particularly to such an apparatus in which the fuel mixture is substoichiometrically burned by a pre-combustion chamber in conjunction with a main combustion chamber such that the resultant exhaust gases, mostly deprived of the contained non-combustible substances, which are removed as molten slag, permit to be utilized in the secondary-stage furnace to which the gases are passed from the main combustion chamber.

A further aspect of the present invention is concerned with a transport duct that is interconnected between the primary stage furnace for partial combustion of air-fuel mixtures to generate inflammable raw gases and the secondary-stage furnace for the utilization of the exhaust gases received through the duct from the primary-stage furnace. The duct is designed so as to help reduce the non-combustible by-products contained in the exhaust gases.

2) Description of the Prior Art

Cyclone burners have been known as systems to provide complete combustion of coal, and in universal use with heat exchange equipment such as boilers. A typical cyclone burner consists of a water-cooled horizontal cylinder and a main combustion chamber. Fuel or pulverized coal is first introduced into the cylinder at one end thereof and picked up by a stream of air flowing in a tangential direction to the cylindrical main chamber. Blended into the tangential air stream into the main chamber, the pulverized coal is given rapid swirling motion while it is being burned in the heat generated in the cyclone burner main chamber by a burner unit which is fired in advance to heat the main chamber to proper temperature that insures complete combustion of the fuel.

In the process, the non-combustibles, such as ash, present in the fuel are centrifuged onto the cyclone burner wall to form a film of molten slag on the wall. A small quantity of relatively fine coal particles burn in their flight through the cyclone burner while the vast majority of the coal is large coal particles which are centrifuged onto the wall. These larger particles adhere to the molten slag film on the wall and burn while on the wall. As a result, high-temperature gases completely burned by products, such as carbon dioxides are generated, and are allowed to flow into a furnace. In the furnace, which essentially forms the secondary-stage furnace of a boiler, the completely burned gases are utilized to produce steam in the boiler.

However, these conventional cyclone burners have been found to pose problems. First, reaction in the combustion chamber of the cyclone burners tend to have 10~20% of the non-combustible by-products in the air-fuel mixture left suspended in molten stage in the resultant raw gases being passed into the associated secondary-stage furnaces. When the raw gases are further burned in the secondary-stage furnaces, these non-combustibles fall and deposit in their internal bottom.

Where the boilers are of the type having a heat convection surface directly installed in their secondary-stage furnace, the non-combustibles as molten slag adhere to the surface, causing undesirable trouble in the system such as contamination and premature wear.

Furthermore, when the raw gases stream into the secondary-stage furnace, part of the non-combustibles in molten state is left adhered to the surface of the baffle, a perforated dividing wall between the cyclone burner and secondary-stage furnace, to form a layer of more or less hardened slag. When the next stream of raw gases bursts passing the baffle, they tend to scrape some of the slag off the baffle surface, and bring it with them into the secondary-stage furnace where the slag deposits at its bottom.

In addition, these cyclone burners are often built too large to insure stable ignition or steady inflammation at desired temperature. Secondly, their designs are such that the combustion chamber operating environment tends to speed reaction, causing the coal to burn into too a rapid expansion of gases to develop a swirling motion. As a result, there would be no enough momentum in the resultant exhaust gases that could enable the non-combustibles present in the gases to be centrifuged onto the combustion chamber wall, making it difficult to permit proper removal of the non-combustibles as molten ash.

U.S. Pat. No. 4,542,704, Braun, discloses another example of a furnace system for combustion of coal by ash removal. The furnace comprises a primary-stage, a secondary-stage and a tertiary-stage furnace in which coal with a high sulfur content is burned in such a manner to reduce the non-combustible particulates and sulfur pollutants present in the resultant exhaust gases. This is achieved by blending into the coal an additive that reacts with sulfur in the first-stage reaction in which the coal is exposed to heat below the ash fusion temperature. The resultant incompletely burned exhaust gases are then further burned in the secondary-stage furnace at or above the ash fusion temperature to generate inflammable raw gases which are caused to undergo complete combustion in the presence of sufficient air to produce steam in the tertiary-stage furnace to which the primary-stage and the secondary-stage furnace are connected.

However, the Braun's furnace also has been proved to suffer from various difficulties. Partial combustion requires that the primary-stage furnace be burned with a set of operating parameters. For example, the amount of air to be blended with the fuel is limited to 75% or below of the required volume to fully burn that fuel. The furnace reaction temperature is maintained at 800~1,050 degree Celsius, too low a level to insure stable ignition and sustained combustion. Furthermore, the resultant exhaust gases are relatively low in temperature enough to provide stable complete combustion in the secondary-stage furnace.

In addition, with Braun, if the heat in the secondary-stage furnace fell below rating, the ratio of fuel mixed in the air-fuel mixture used at the primary-stage furnace is increased until the secondary-stage combustion environment reaches the rating. However, this would result in a plunge in the temperature of the primary-stage furnace. When the ratio of air in the mixture is increased to boost the temperature of the resultant exhaust gases, a localized excess of heating occurs in the primary-stage furnace. This would make it impossible to achieve the claimed objects of the Braun system of fusing part of the non-combustibles in the primary-stage combustion and maintaining the secondary-stage combustion environment at or above the ash fusion temperature.

SUMMARY OF THE INVENTION

The present invention has been proposed to eliminate the above-mentioned difficulties of drawback with the prior art furnaces for partial combustion of coal.

It is therefore a primary object of the present invention to provide a furnace with a built-in pre-combustion chamber for partial combustion of coal to generate inflammable raw gases almost free from non-combustible products for further burning to produce steam in a boiler.

It is another object of the present invention to provide such a furnace which is capable of stable ignition of the air-fuel mixture and sustaining proper inflammation in the furnace.

It is a further object of the present invention to provide such a furnace in which means are provided to control the volume ratio of the air-fuel mixture to maintain desired combustion parameters in the furnace.

It is a still further object of the present invention to provide such a furnace having a curved transport duct, which is interconnected between the furnace for primary-stage and a secondary-stage furnace for complete combustion of the inflammable raw gases passed from the primary-stage furnace, which helps reduce small quantities of residual non-combustible products left suspended in the gases being passed into the secondary-stage furnace.

The above and other objects, features and advantages of the present invention are achieved by a furnace which mainly comprises of a pre-combustion chamber and a main combustion chamber to provide for partial combustion of fuel, preferably a mixture of pulverized coal and air, to generate inflammable raw gases. The furnace may constitute the primary-stage furnace of a boiler system to supply its raw gases to the secondary-stage furnace in which the received raw gases are utilized for a variety of a processes.

Partial coal combustion is defined as substoichiometrical burning of a fuel-air mixture in the primary-stage furnace of a boiler system at or above the ash fusion temperature to generate incompletely burned, inflammable exhaust gases, which are passed to the secondary-stage furnace where the exhaust gases are utilized for process or electric power generation.

The primary-stage furnace according to the present invention comprises a vertical pre-combustion chamber of largely cylindrical configuration and a likewise cylindrical horizontally-laid main combustion chamber to which the outlet port of the pre-combustion chamber is tangentially connected. Pulverized coal, along with air, is introduced at the inlet port of the pre-combustion chamber to produce a stream of air-fuel mixture which starts burning in the heat of a burner unit mounted in the pre-combustion chamber. The burner unit may preferably been fired to heat in advance the pre-combustion chamber to a temperature that converts the fuel mixture to a half-burned mix of incompletely burned fuel particles, exhaust gases and molten non-combustible products.

Swirler means provided at the inlet port give the mixture swirling motion in which the half-burned mixture travels throughout the pre-combustion chamber into the main combustion chamber through a tangential induction port interconnected between the pre-combustion and main combustion chambers.

The half-burned mixture, upon entering the main combustion chamber through the tangential passage thereto, develops into a rapidly swirling vortex in the chamber which is pre-heated at or above the ash fusion temperature. The mixture, while rapidly moving in a vortex, is caused to undergo partial combustion generating inflammable raw gases containing combustible products, such as carbon monoxides and hydrogen.

The non-combustible products present in the raw gases, such as ash, are centrifuged as molten slag onto the wall of the main combustion chamber forming the outermost portion of the vortex. The slag can be removed through a tapping port formed in the main combustion chamber wall. In this way, the majority of the non-combustible products can be eliminated before the generated raw gases are passed into the secondary-stage furnace to be further burned to produce steam or to be utilized for process.

Also, the primary-stage furnace of this invention is provided with multiple air inlet ports that are connected through separate lines to an air source. The air inlet ports each permit selective connection to provide a varying amount of air to the primary-stage furnace thereby providing control of the combustion chamber operating parameters including temperature and the chemical composition of the raw gases being generated.

Furthermore, because of the design of the present invention that the vertical pre-combustion chamber is located above the main combustion chamber so that the tangential injection port interconnected between them stands completely out of exposure to the disturbing effects of the rapidly swirling vortices of burning raw gases in the main combustion chamber, to prevent the port from plugging by coal particles or ash present in the gases.

In a preferred embodiment according to the present invention, a water-cooled curved transport duct is interconnected between the main combustion chamber of the primary-stage furnace and secondary-stage furnace. The inlet opening of the transport duct is joined to the outlet port of the main combustion chamber at a point below where the outlet end of the transport duct opens into the secondary-stage furnace.

Although the process of partial combustion in the primary-stage furnace is very effective in getting the resultant raw gases deprived of non-combustible products, such as ash, it is possible that the generated raw gases passed from the main combustion chamber to the secondary-stage furnace may have a very small quantity of such ash left unremoved. In this embodiment, such residual ash and other non-combustible particles suspended in molten state in the raw gases being passed through the curved passage of the transport duct are allowed to cool off upon contact with the cooled inner duct surface wall, dropping off down the duct into the main combustion chamber where it will melt again, entrained in the next swirling vortex of burning exhaust gases within the main combustion chamber.

DETAILED DESCRIPTION OF PREFERRED EMBODIMENTS

Preferred embodiments of the present invention will be described in full detail in conjunction with the accompanying drawings.

Figure 1:
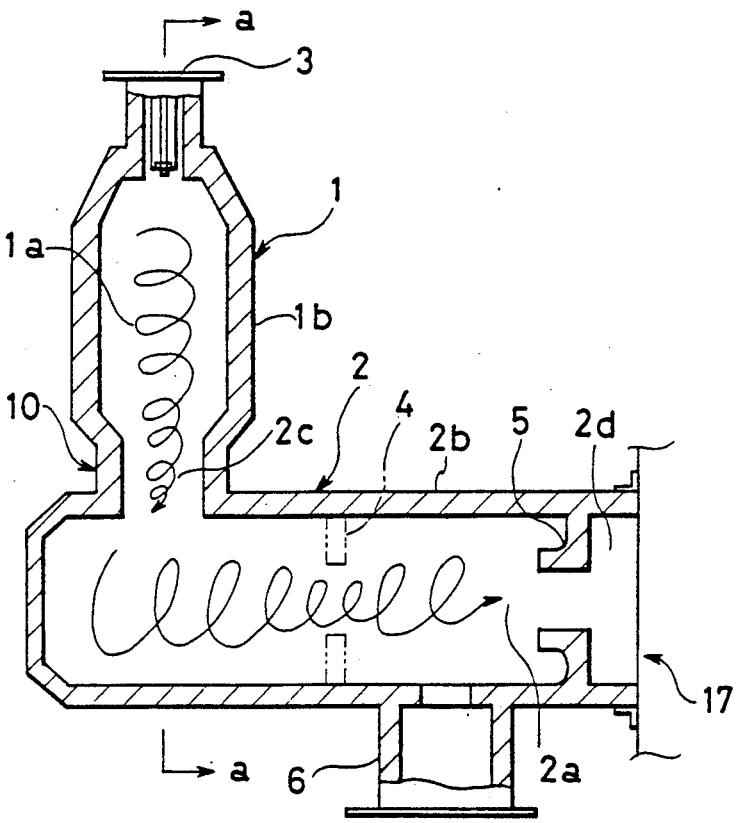
FIG. 1 is a schematic side cross-sectional view of a primary-stage furnace with a pre-combustion chamber and main combustion chamber connected for partial combustion of coal to generate inflammable raw gases, constructed in accordance with a first preferred embodiment of the present invention.
Figure 2:
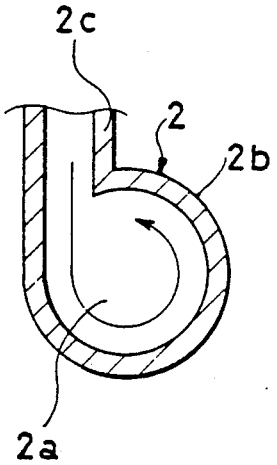
FIG. 2 is a cross-sectional view taken along the line a—a of FIG. 1.

Referring first to FIGS. 1 and 2, which is a first embodiment of a primary-stage furnace 10, pair of a main combustion chamber and an auxiliary or pre-combustion chamber, constructed in accordance with the present invention, a vertical pre-combustion chamber, largely designated at 1, is connected at upstream to a main combustion chamber 2 that is mounted in horizontal position.

The pre-combustion chamber 1, in combination with the main combustion chamber 2, makes up the primary-stage reaction burner of a boiler system for partial combustion of air-fuel mixtures to generate incompletely-burned inflammable raw gases which are passed to the secondary-stage reaction burner where the received combustible raw gases are further combusted to produce steam.

The pre-combustion chamber 1 comprises a combustion chamber 1*a* having a substantially cylindrical housing 1*b* which defines a reaction zone and, at a top portion thereof, a fuel inlet port 3 through which a mixture of solid fuel and oxidizer gas is introduced into the combustion chamber 1*a*. The inlet port 3 may preferably be centered at the top of the furnace 1, and aligned with the axis of the cylindrical combustion chamber 1*a*.

The solid fuel in the mixture may preferably be pulverized bituminous or subbituminous coal. Char may also be used. The oxidizer gas may be air, used to blend with the solid fuel to sustain substoichiometrical combustion of the mixture in the combustion chamber 1*a*.

The inlet port 3 may preferably be fed with air from multiple air supplies which are connected to the inlet port 3 in such a manner that it can receive a varying amount of air by the selective connection of one or more of the air supplies at the inlet port 3 to the combustion chamber 1*a*.

In this particular embodiment, the inlet port 3 receives three separate streams of air as oxidizer gas from an air source through either a single common air injection nozzle or multiple nozzles provided in the inlet port 3. The air injection nozzles supply in combination the pre-combustion chamber 1 with the amount of air just required for desired partial combustion in the main combustion chamber 2.

The inlet port 3 includes a known swirler means, not shown, which is connected to receive air from one of the air injection nozzles. Using the air from the associated air injection, the swirler gives a swirling motion to the fuel mixture introduced through the inlet port so that the mixture, upon entering the combustion chamber 1*a*, develops into a swirling stream. Such swirler means can be of any conventional type, and here will not be detailed since it is well known to those versed in the art.

Ignited by the heat generated in the reaction zone of the combustion chamber la by a burner, not shown, or from previous combustion reactions, the rapidly swirling fuel mixture then undergoes substoichometrical combustion, turning into inflammable gases containing incompletely burned products within a very short time of residence in the small combustion chamber 1*a*.

Thus, the pre-combustion chamber 1, following initial ignition, is maintained at stable temperature levels to ignite the next fuel mixture through the injection duct 3. The pre-combustion chamber 1 may preferably been heated by the burner, not shown, to operating temperature which can ignite a fuel mixture in advance of the start of the furnace operation.

The exhaust gases generated then stream downward to burst into the main combustion chamber 2 through an intermediary injection duct 2*c* that is mounted at the bottom of the pre-combustion chamber 1. The exhaust gases stay for a very short period of time in the combustion chamber 1*a* of the pre-combustion chamber 1 because of its downdraught speed.

The main combustion chamber 2 has a horizontal cylindrical housing 2*b* which defines a combustion chamber 2*a* of larger volume than that for the combustion chamber 1*a* of the pre-combustion chamber 1. The intermediate injection duct 2*c* is positioned tangencialy to the side wall of the cylindrical housing 2*b* of the main combustion chamber 2, as can be best presented in FIG. 2.

This arrangement is provided such that, when the exhaust gas stream from the combustion chamber 1*a* is passed into the combustion chamber 2*a* through the tangential passage of the intermediate injection duct 2*c*, its course naturally follows a curved path along the inside wall of the housing 2*b*, as indicated by the arrow in FIG. 2.

As a result, the entering exhaust gases develop into a high-velocity, aerodynamically swirling vortex in the combustion chamber 2*a* of the main combustion chamber 2, and begin to undergo further burning, converting almost all their incompletely combusted carbon content to inflammable by-products, such as carbon monoxides and hydrogen.

The resultant inflammable raw gases stream through the combustion chamber 2*a* passing an intermediate baffle 4, mounted at mid point in the main combustion chamber, toward the outlet port 2*d* of the main combustion chamber 2 and bursts passing a baffle 5, mounted at the downstream end of the chamber, through a raw gas transport duct into the second-stage furnace 17 in which the received inflammable raw gases are passed.

The installation of the baffle 4, which is intended to temper the bursting force of the rapidly swirling exhaust gases in the main combustion chamber 2, depends on the combustion chamber operating temperature or the type of the coal used.

The temperature generated and maintained in the substoichiometrical combustion of exhaust gases in the reaction chamber 2*a* of the main combustion chamber 2 is sufficiently high enough to heat most of the non-combustible products contained in the gases, rendering them to molten state. In the rapidly swirling vortex of the exhaust gases, these molten non-combustibles are centrifuged on the inner wall of the combustion chamber 2*b* forming the outermost port of the exhaust gas vortex, flowing along the circular inner wall of the horizontal housing down to a tapping port 6 provided at the bottom of the chamber 2*b* through which the slag can be extracted out.

Because of its location above the horizontal chamber 2*b* of the main combustion chamber 2, the inlet port 3 stands out of reach of the disturbing effects of the burning raw gases in rapidly swirling vortices down in the combustion chamber 2*a*, almost without exposure of backlash of non-combustible particles or ash that may cause plugging in the inlet port 3.

Figure 3:
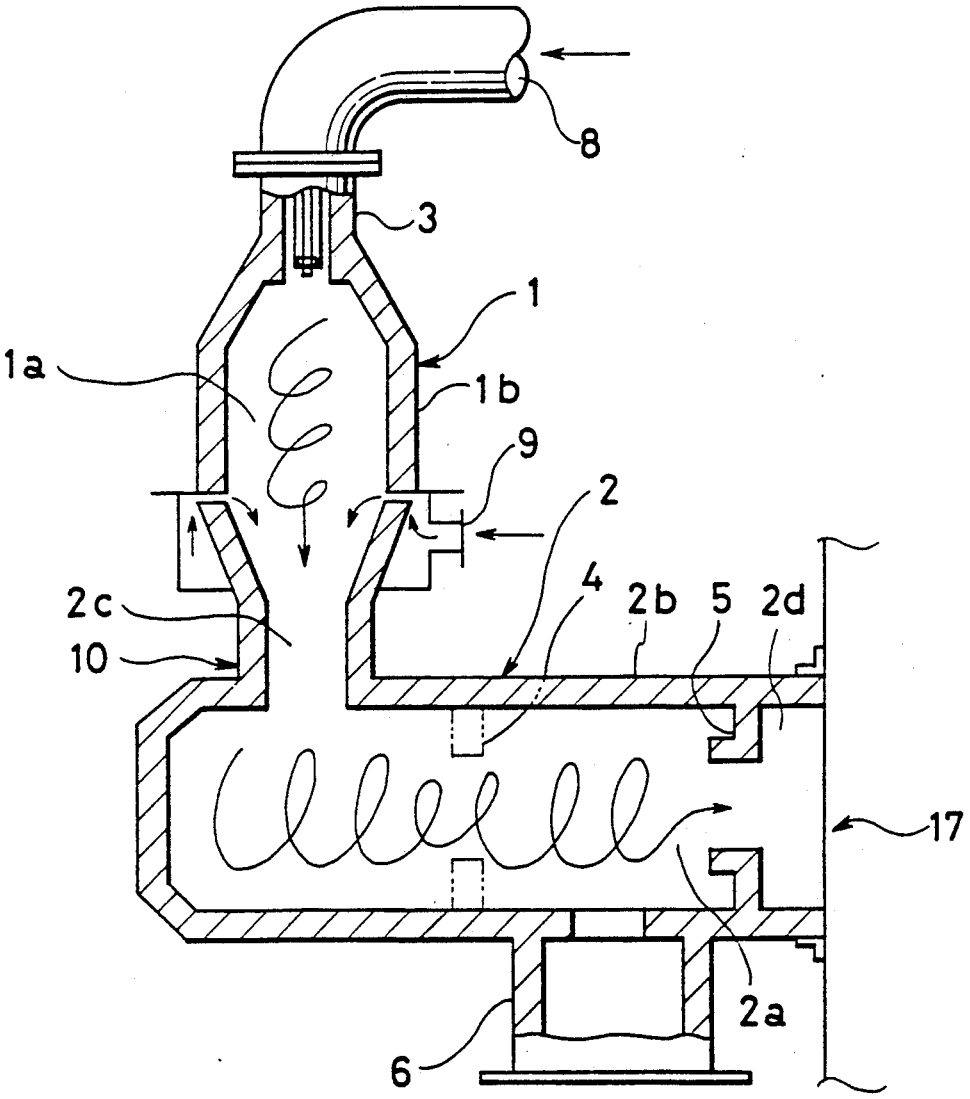
FIG. 3 is a schematic side cross-sectional view of a primary stage furnace with a pre-combustion chamber and main combustion chamber connected for partial combustion of fuel to generate inflammable raw gases, built according to a second preferred embodiment of the present invention.

Referring then to FIG. 3, a furnace for partial combustion of air-fuel mixtures in accordance with a second preferred embodiment will be explained, which is substantially similar to the earlier embodiment described in association with FIG. 1. Therefore, with like components referred to by like numbers, description will be limited to where this particular embodiment differ from the earlier one to avoid unnecessary repetition.

An additional air injection port 9 is mounted in the main combustion chamber 2 at downstream of the pre-combustion chamber 1 to supply air from an air supply. The air injection port 9 supplies a further amount of air to the main combustion chamber 2, in addition to the rest of the air injection ports provided at the inlet port 3 to supply the required air volume for proper partial combustion.

Also, the air injection port 9 is oriented in an direction to generate a stream of air in line with the swirling motion of the burning raw gases in the combustion chamber 2*a*. The air from the air injection nozzle 9 is provided to help sustain the combustion of raw gases swirling in vortices in the combustion chamber 2*a* at the desired temperature, thereby facilitating the heating of the non-combustibles present in the gases to molten stage.

Figure 4:
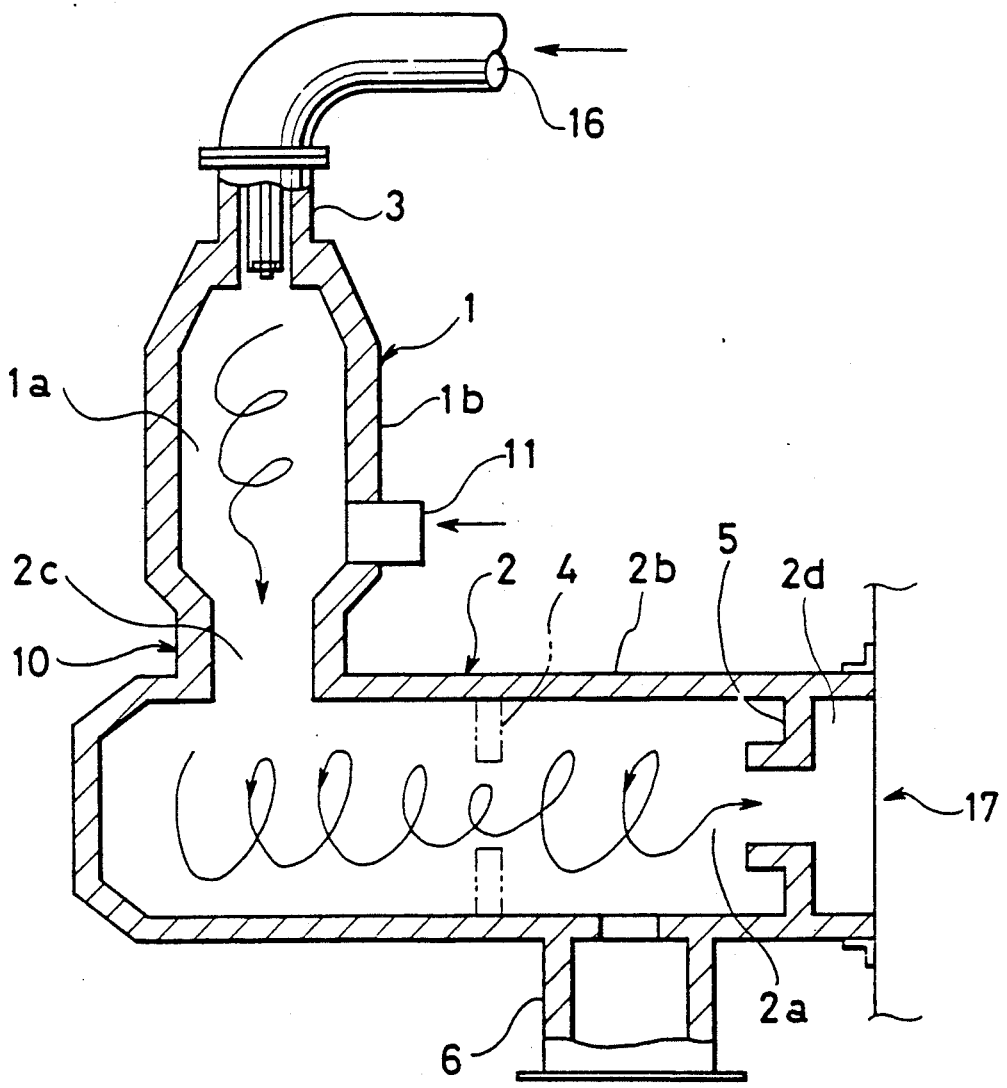
FIG. 4 is a schematic side view of a primary-stage furnace with a pre-combustion chamber and main combustion chamber connected for partial combustion of fuel to generate inflammable raw gases, designed in accordance with a third preferred embodiment of the present invention.

Referring now to FIG. 4, the first-stage furnace for partial combustion of fuel mixture is shown according to a third embodiment of the present invention.

The apparatus of this particular embodiment is largely similar to the previous embodiment explained in connection with FIG. 1, with like numbers used to refer to like components. Therefore, description will be given to where this embodiment differs from the earlier one.

Apart from an injection port 16 that is provided at a top end of the inlet port 3 to supply air and pulverized coal (or char), the pre-combustion chamber 1 carries at a downstream end thereof an additional fuel injection port 11 to supply the main combustion chamber 2 with a second charge of pulverized coal or char with air as oxidizer gas.

In this embodiment, the volume of pulverized coal (or char) discharged from the injection port 16 is determined as equivalent to one third of the rate required for partial combustion at rating in the main combustion chamber 2. Also, the amount of air supplied from the three air supplies at the injection port 16 is also limited to the rate that would sustain the burning of the undersupplied solid coal quantity.

When the air-fuel mixture from the injection port 16, following ignition in the pre-combustion chamber 1 to burn, in the presence of undersupplied air from the three separate air supplies, bursts down the vertical combustion chamber 1*a* toward the second fuel inlet port 11.

The second fuel injection port 11 is adapted to supply the remaining two-thirds of fuel and air to compensate for the air-fuel mixture coming from the first injection port 16. Also, the second injection port 11 is oriented to direct its air-fuel discharge in a direction tangential to the combustion chamber 2*a* of the main combustion chamber 2.

Thus, the compensatory air-fuel mixture from the second injection port 11 will be ignited by the burning mixture from the first injection port 16, while forced by its downward momentum all way along the combustion chamber 1*a* of the pre-combustion chamber 1, and will flow into the combustion chamber 2*a* in which the combined fuel is further burned at or above the ash fusion temperature.

The flow rate of the air and pulverized coal (or char) passing the inlet port 13 and the second injection port 11 be controlled by a regulating means of any conventional type, not shown, and here will not be detailed since it is well known to those versed in the art.

This arrangement provides for the supply of fuel into the combustion chamber 1*a* in less combustion state than in earlier embodiments so as to achieve more stable and controlled partial combustion in the main combustion chamber 2.

Figure 5:
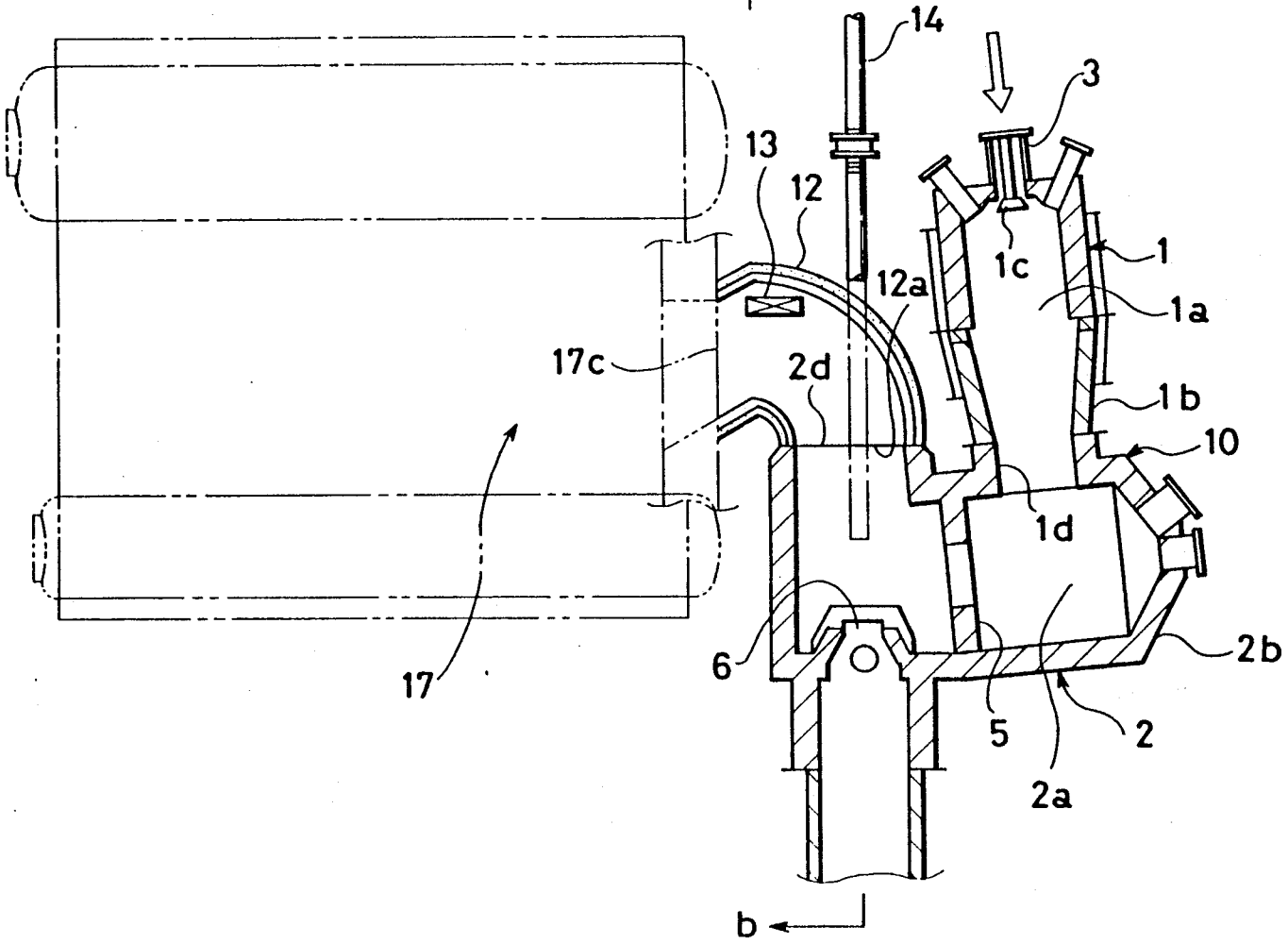
FIG. 5 is a schematic cross-sectional side view of a main combustion chamber with a pre-combustion chamber connected to make up a first-stage furnace for partial combustion of coal to produce inflammable raw gases, with a curved connecting transport duct to convey the generated gases to a secondary-stage furnace, designed in accordance with a fourth embodiment of the present invention.
Figure 6:
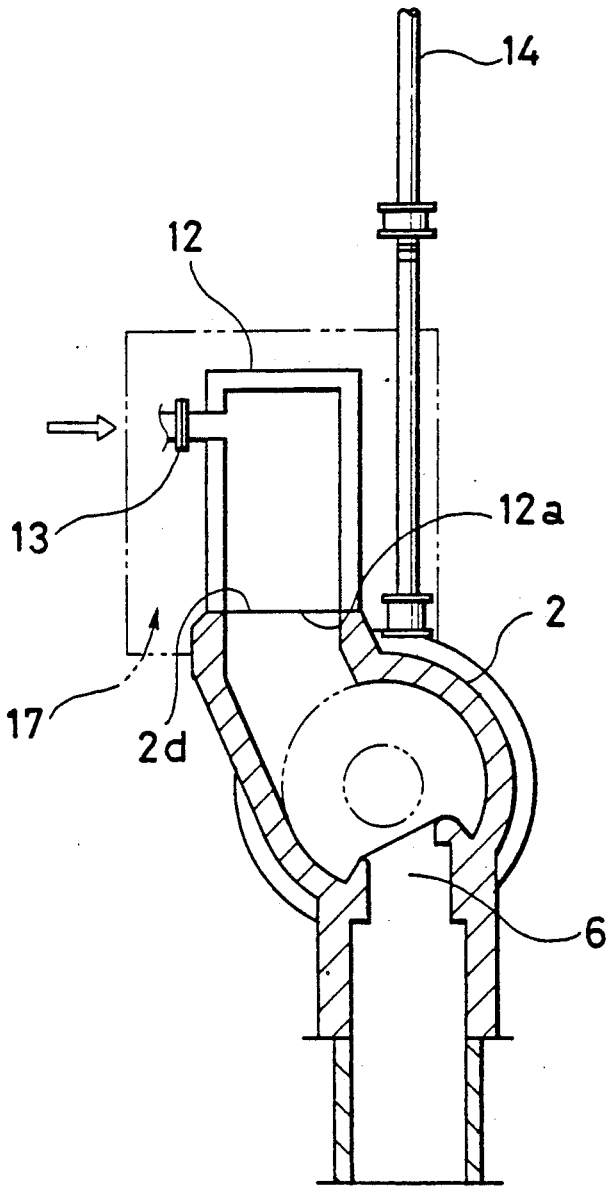
FIG. 6 is a cross-sectional view taken along the line b—b of FIG. 5.

Referring further to FIG. 5, a first-stage furnace 10 for partial combustion of fuel to produce raw gases, constructed in accordance with the present invention, is shown, which comprises a main combustion chamber 2, a pre-combustion chamber 1 and an curved transport duct 12 interconnected between the main combustion chamber 2 and a secondary-stage furnace 17. The transport duct 12 is adapted to pass the raw gases generated by the first-stage furnace 10 to the secondary-stage furnace 17 where the received raw gases are passed.

Similar to the previous embodiments described earlier in association with FIGS. 1 and 3, the first-stage furnace 10 produces inflammable raw gases containing combustible by-products, such as carbon monoxides and hydrogen which are passed to the secondary-stage furnace 17 in which the received raw gases are passed.

Also, in this particular embodiment, like components are referred to by similar numbers as in FIG. 1, with description will be confined to where the embodiments differ from each other for brevity's sake.

It is important to note that the transport duct 12 provides the best performance when it is applied in a boiler system where the transport duct has its inlet end opening 12*a* connected to the outlet port 2*d* of the main combustion chamber 2 is below where the outlet end of the duct 12 opens into the secondary-stage furnace 17 as depicted in FIG. 5. In this layout the raw gases exiting the main combustion chamber 2 must climb up the transport duct 12 into the secondary-stage furnace 17 through its inlet port 17*c*.

The transport duct 12 is provided to remove the residual non-combustible particles and ash present in molten state in the raw gases being passed from the main combustion chamber 2 to the secondary-stage furnace 17. Although partial combustion in the combustion chamber 2*a* can eliminate as molten slag the majority of such non-combustibles contained in raw gases generated therein through the tapping port 6, there may remain a very small quantity of ash and fine coal particles in the gases exiting the main combustion chamber 2.

Thus, the transport duct 12 may preferably be made of a material having fast heat transfer, such as metal, such that molten residual non-combustibles suspended in the raw gases being passed through the transport duct would cool to solidify, and drop again into the combustion chamber 2*a*. In the reaction zone of the main combustion chamber 2, the solidified non-combustibles from the transport duct 12, entrained in the rapidly swirling vortex of high-temperature raw gases generated from the next charge of fuel mixture, will melt again so that they can be centrifuged as molten slag onto the main combustion chamber wall 2*b* and removed through the tapping port 6.

Also, the transport duct 12 may preferably carry therein a water cooling pipe, not shown, that runs through or around its metal walls to speed cooling of the molten residual non-combustible products present in the raw gases through the transport duct 12.

Also, as illustrated in FIG. 5, the transport duct 12 is bent at its mid-point to have a largely horizontally extending portion directly joined the outlet port 2*d* of the main combustion chamber 2. With this arrangement, the raw gases bursting into the transport duct 12 from the main combustion chamber 2 through its outlet port 2*d*, are made to follow disturbed curbed paths in the transport duct 12 because of the bend. As a result, the molten residual non-inflammable products are also caused to follow irregular, zig-zag paths thereby increasing their degree of impinging the cooling wall surface of the transport duct 12, so that they will drop into the main combustion chamber 2*a*.

An air-injection port 13 may preferably be provided in the secondary-stage furnace 17 adjacent to its inlet port 17*c*, at a level generally flush with the edge of the opening of the inlet port 17*c* to which the transport duct 12 is joined.

The air injection port 13 is connected through a passage, not shown, to an air supply, also not shown, which sends drafted air to the secondary-stage furnace 17. The injection port 13 is oriented at an angle to produce a stream of air in a direction that gives the inflammable raw gases just entering the secondary-stage furnace 17 swirling motion. With this arrangement, this generated swirling movement insures homogeneous complete combustion of the inflammable gases in the secondary-stage furnace 17.

Furthermore, the curved transport duct 12 may preferably be provided with a deslagging lance 14 which is used to clean the tapping port 6. The installation of the deslagging lance 14 may result in the transport duct 12 having to be substantially inclined between the main combustion chamber 2 and the secondary-stage furnace 17. Even in such a structure, the raw gases passed through the transport duct 12 can achieve the same effect of separating their residual non-combustible by-products, and of guiding the cleaned gases into the secondary-stage furnace 17.

What is claimed is:

1. An apparatus for partial combustion of fuel in a first-stage furnace consisting of a main combustion chamber to generate inflammable exhaust gases which are passed to a secondary-stage furnace, comprising:

a vertical pre-combustion chamber having a substantially cylindrical combustion chamber;

an inlet port provided in the pre-combustion chamber at an upper end thereof to supply a single mixture of solid fuel and oxidizer gas to the pre-combustion chamber;

a burner adapted to heat the pre-combustion chamber to ignite the fuel-oxidizer gas mixture introduced from the inlet port to burn at a temperature that converts the mixture into a mix of incompletely-burned fuel particles, inflammable exhaust gases and downwardly flowing non-combustible products in molten state;

a main combustion chamber lain in horizontal position and connected to a downstream end of the pre-combustion chamber, the main combustion chamber having a substantially cylindrical combustion chamber;

an intermediary injection duct having a restricted outlet passage mounted at the bottom of said pre-combustion chamber through which said exhaust gases downwardly flow, said restricted outlet passage forming a tangential passage interconnected between the pre-combustion chamber and the main combustion chamber, the tangential passage being provided to cause the half-burned mix through the combustion chamber of the pre-combustion chamber to develop into a high-velocity swirl in the main combustion chamber; and a tapping port provided in the main combustion chamber to extract the non-combustible products as molten slag as they are centrifuged onto the wall of the main combustion chamber to form the outermost film of the high-velocity swirling vortex.

2. An apparatus as set forth in claim 1, wherein a bent upwardly extending transport duct is connected to carry the inflammable exhaust gases from an outlet port of the main combustion chamber to the secondary-stage furnace through an inlet port of the secondary-stage furnace, the inlet port of the secondary-stage furnace being situated above the inlet port of the secondary-stage furnace being situated above the outlet port of the main combustion chamber.

3. An apparatus as set forth in claim 2, wherein the transport duct carries at an upper end thereof an inlet port to provide an additional stream of air directed to the secondary-stage furnace.

4. An apparatus as set forth in claim 2, wherein the transport duct is surrounded with cooled wall surface inside the transport duct.

5. An apparatus as set forth in claim 2, wherein the main combustion chamber carries at a top rear end thereof a deslagging lance which can be vertically moved to clean a tapping port that is provided at a bottom rear end of the main combustion chamber, with the transport duct being connected to the main combustion chamber at an inclined position.

6. An apparatus as set forth in claim 2, wherein the pre-combustion chamber carries between a downstream end portion thereof and the main combustion chamber an inlet port to supply an additional stream of air directed to the combustion chamber of the main combustion chamber.

7. An apparatus as set forth in claim 2, wherein the pre-combustion chamber carries between a downstream end portion thereof and the main combustion chamber an inlet port to supply an additional stream of solid fuel and oxidizer gas directed to the combustion chamber of the main combustion chamber.

* * * * *